US005487679A

United States Patent [19]

Quaintance

[11] Patent Number: 5,487,679

[45] Date of Patent: Jan. 30, 1996

[54] ELECTRIC CONNECTOR

[76] Inventor: Laythol W. Quaintance, HCl 4415, Pima, Ariz. 85543

[21] Appl. No.: 247,600

[22] Filed: May 23, 1994

[51] Int. Cl.[6] ..... H01R 4/24

[52] U.S. Cl. ..... 439/428; 439/805; 24/136 B

[58] Field of Search ..... 439/427, 428, 439/784, 805, 807, 863; 24/136 R, 136 B, 136 L, 122.6

[56] References Cited

U.S. PATENT DOCUMENTS

| | | | |
|---|---|---|---|
| 2,777,117 | 1/1957 | Shrider . | |
| 3,560,909 | 2/1971 | Wyatt et al. . | |
| 5,228,875 | 7/1993 | Swenson, Sr. | 439/428 X |

FOREIGN PATENT DOCUMENTS 879864 10/1961 United Kingdom .

*Primary Examiner*—Khiem Nguyen
*Attorney, Agent, or Firm*—Ancel W. Lewis, Jr.

[57] ABSTRACT

An electric connector disclosed for a wide range of conductor sizes has interfitting female and male connector members that flare conductive strands of an electric conductor or cable. The outer contact surface is provided by a malleable material having a hardness less than the hardness of the strands and the strands are pressed into said outer contact surface to increase the contact surface area between the strands and male connector member. A converging passage between the connecting members provides a substantially uniform distribution of the strands around the periphery and press the strands against an outer contact surface of the male connector member and the surfaces of the connector members are shaped in such a way as to provide increased contact surface area and avoid breaking, weakening or kinking of the strands.

7 Claims, 1 Drawing Sheet

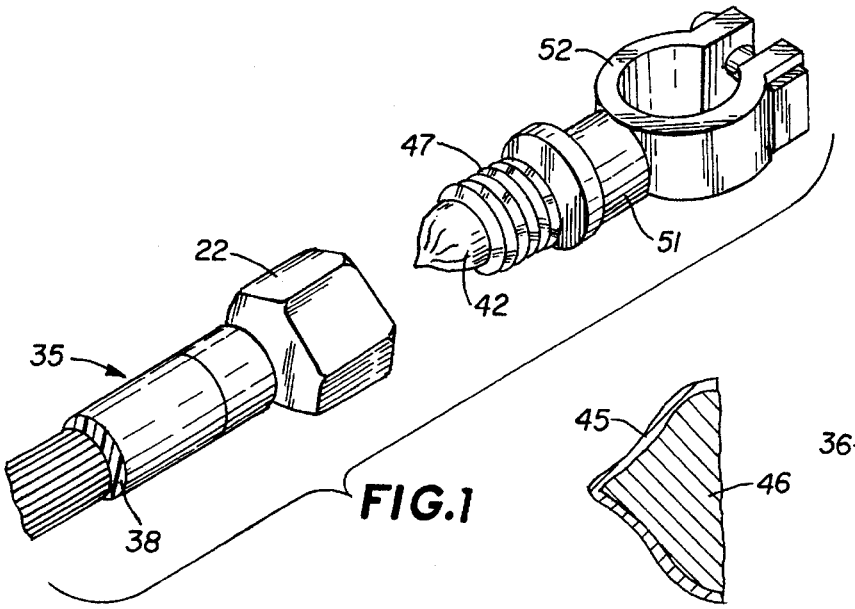
FIG.1
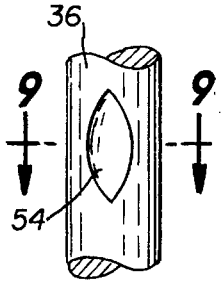
FIG.8
FIG.3
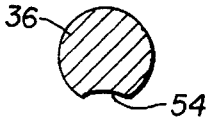
FIG.9
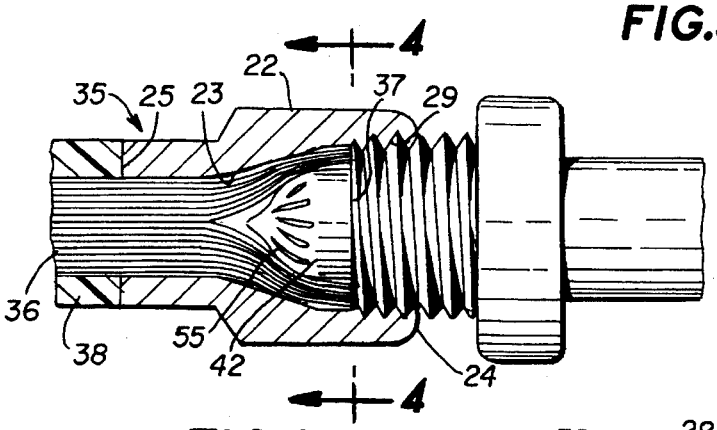
FIG.2
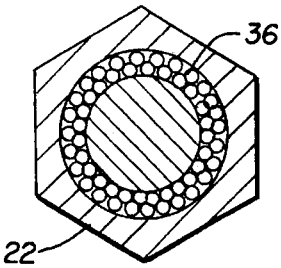
FIG.4
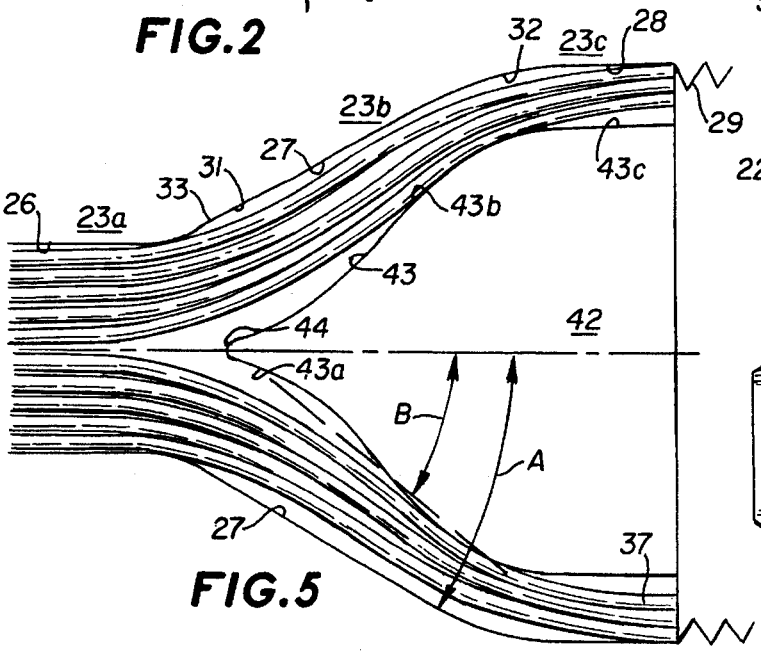
FIG.5
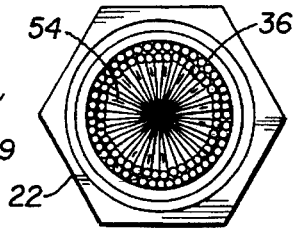
FIG.6
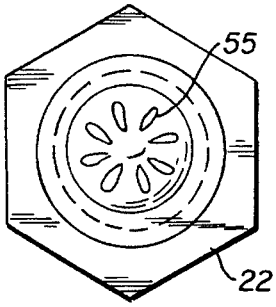
FIG.7

ELECTRIC CONNECTOR

TECHNICAL FIELD

This invention relates to electric connectors for attachment to electric conductors and cables.

BACKGROUND ART

There are a number of applications for reliable electric connectors that readily attach to a conductor having a plurality of conductive strands. Some attempts have been made to provide electric connectors in which the conductive strands are flared radially away from the longitudinal axis of the conductor or cable and against an outer contact surface of two releasably connected interfitting male and female connector members. Representative prior art patents are U.S. Pat. Nos. 2,777,117; 3,560,909; and British Patent No. 879,864. The deficiencies in the prior art are structures that tend to cause breaks or weaknesses in the conductive strands, not providing maximum surface area contact, lacking in ruggedness, and lacking in ease of assembly and disassembly and deficiencies due to crimping and breaking of the strands as well as non-uniformity of distribution of the strands around the periphery of the interfitting connector members for maximum contact with an associated connector member.

DISCLOSURE OF THE INVENTION

Connectors disclosed have a female connector member with a gradually enlarging bore section defining a tapered inner contact surface, an electric conductor having a bundle of electrically conductive strands terminating at an end in said enlarged bore section, and a male connector member concentrically arranged within the female connector member. The male connector member has an outer contact surface surrounding said inner contact surface and converging toward and terminating in a pointed end and extending into the end of the conductor to flare the strands. The outer contact surface is made of a malleable material having a hardness less than the hardness of the strands so that the strands make depressions in the malleable material to increase contact surface area between the strands and the male connector member. The inner and outer contact surfaces have rounded convex surface portions that form depressed, flattened areas in the strands when compressed between the connector members to provide increased surface contact area with the male connector member. The inner and outer contact surfaces form a converging passage that serves to substantially uniformly distribute the strands substantially around the periphery of the outer contact surface to maximize the strands that contact the male connector member.

BRIEF DESCRIPTION OF THE DRAWINGS

Details of this invention are described in connection with the accompanying drawings which like parts bear similar reference numerals in which:

FIG. 1 is a perspective view showing male and female connector members in a separated position.

FIG. 2 is a longitudinal sectional view showing the connector members of FIG. 1 connected together as an assembly in the normal operating position.

FIG. 3 is a sectional view of an alternative male connector member.

FIG. 4 is a sectional view taken along line 4—4 of FIG. 2.

FIG. 5 is an enlarged schematic view showing a portion of the assembly of FIG. 2.

FIG. 6 is an end view showing the female connecting member and the strands in a spread, flared position after once having been assembled.

FIG. 7 is an end view of the male connector member after once having been assembled.

FIG. 8 is an enlarged elevational view of one strand in which a depression has been made.

FIG. 9 is a sectional view taken along line 9—9 of FIG. 8.

DETAILED DESCRIPTION

Referring now to the drawings there is shown an electric connector assembly embodying features of the present invention which includes a female connector member 22 having a flat sided or hex-headed outer shape for turning with a wrench and a hole or throughbore 23 extending between opposite outer and inner ends 24 and 25, respectively. The throughbore 23 has a smaller straight bore section 23*a* with a smaller inner surface 26 of substantially uniform diameter and is concentrically arranged about a longitudinal axis of the female connector member 22 together with an enlarged tapered bore section 23*b* that gradually enlarges away from the smaller straight bore section 23*a* to provide a tapered inner contact surface 27 and a larger straight bore section 23*c* with an inner surface 28 of uniform diameter. Internal threads 29 are provided along the inside of the larger straight bore section 23*c*. The inner contact surface 27 of the female connector member is generally disposed along an angle designated A relative to the longitudinal axis of the connector member 22 of about thirty degrees.

The smaller inner surface 26 merges with inner contact surface 27 at a rounded, convex inner surface 31 and the inner surface 27 merges with inner surface 28 at a rounded concave inner surface 32 to avoid kinking or breaking of a strand pressed against surface 31 and surface 31 will form a depression or compressed, flattened area 33 in the strand 36 in contact with the male connecting member for increased contact surface area.

An electric conductor 35 has a plurality or bundle of electrically conductive wires or strands 36 which extend through the throughbore 23 and terminate in an end 37 in the larger bore section 23*c*. A non-conductive or insulator cover 38 surrounds the strands 36.

A solid male connector member 42 of electrically conductive material has an outer contact surface 43 that generally converges toward a pointed end or tip 44 and when positioned in the assembly extends into the conductor to radially outwardly flare the strands at the end of the conductor 35. The outer contact surface 43 tapers at an angle designated B relative to the longitudinal axis of member 42 of about forty degrees to the longitudinal axis of member 42 to form a converging passage 46 proceeding toward the end 37 of the conductor. The converging passage 46 causes there to be fewer strands at the periphery and distributes the strands substantially uniformly around the periphery of the outer contact surface 43 so that a maximum number of strands contact the outer contact surface 43. The outer contact surface has a convex contact surface portion 43*a* at the pointed end, an intermediate convex contact surface portion 43*b* of a bulbous shape that merges with an inner contact surface portion 43*c* of uniform diameter. Each of contact surface portions 43*a* and 43*b* form depressions or compressed, flattened areas similar to area 33 in the strand 36 to increase surface area contact. The male connector member 42 connects and is formed as an integral part of a shank 51 of a battery post clamp 52 to illustrate one application for the subject invention using a conductor of finer wire or finer strands.

The male connector member 42 has outer screw threads 47 that thread into the inner screw threads 29 of the female connector member 22 to releasably connect the members together and to advance the male connector member 42 into the female connector member 22 and compress or grip the strands 36 against the conductive contact surfaces to form a tight electrical connection. The rounded convex contact surface portion 43*b* of the male connector member is shown to form a depression or depressed, flattened areas in the conductor as indicated at 54 in FIGS. 8 and 9 to increase the contact surface area between the conductor and the male connector member.

The outer contact surface 43 is provided by a malleable conductive material having a hardness less than the hardness of the strands so that the strands form indentations or depressions 55 in the malleable material. This also increases the contact surface area between the conductors and the male connector member. The converging passage 46 helps to make sure that the strands at the outer periphery will be uniformly distributed about the periphery and each are in contact with the outer contact surface.

Referring now to FIG. 3 there is shown an alternative male connector 42*a* having a tapered body with a layer or coating 45 of malleable material formed on a harder conductive body 46.

The foregoing connector assembly is suitable for a wide range of strand and wire sizes from battery cables to communication wires used on transmission lines. For larger wires the angle B of the contact surface of the male connector member may be up to fifty degrees and the taper may be straight.

Although the present invention has been described with a certain degree of particularity, it is understood that the present disclosure has been made by way of example and that changes in details of structure may be made without departing from the spirit thereof.

What is claimed is:

1. An electric connector comprising:

a female connector member having a central throughbore with a smaller straight bore section of substantially uniform diameter defining a smaller inner surface and an enlarged bore section gradually enlarging away from said straight bore section defining a generally tapered inner contact surface, an electric conductor having a bundle of electrically conductive strands extending through said throughbore and terminating in an end in said enlarged bore section, a male connector member having a tapered outer contact surface converging toward and terminating in a pointed end and extending into said conductor end to flare said strands at said end, said female and male connector members having interfitting connecting means to releasably connect said male connector member to said female connector member and grip said strands between said inner and outer contact surfaces to form an electric connection between said male connector and said conductor, said outer contact surface being provided by a malleable material having a hardness less than the hardness of said strands and said strands are pressed into said outer contact surface to form depressions in said malleable material for increased contact surface area between said strands and male connector member.

2. An electric connector as set forth in claim 1 wherein said male connector member has a coating of malleable material on the surface of a solid core of a harder material.

3. An electric connector as set forth in claim 1 wherein said smaller inner surface and said inner contact surface merge with one another along a rounded inner surface to avoid weakening, kinking and breaking of a strand in contact with said inner surfaces and form a compressed, flattened area in the strand in contact with said rounded inner surface for increased contact surface area between said conductor and said male connector member.

4. An electric connector as set forth in claim 1 wherein said outer contact surface is convexly curved to avoid weakening, kinking and breaking of a strand and form a compressed, flattened area in the strand in contact with said convex curved contact surface for increased contact surface area between said conductor and said male connector member.

5. An electric connector comprising:

a female connector member having a central throughbore with a smaller straight bore section of substantially uniform diameter defining an inner surface and an enlarged bore section gradually enlarging away from said straight bore section defining a generally tapered inner contact surface, an electric conductor having a bundle of electrically conductive strands extending through said throughbore and terminating in an end in said enlarged bore section, a male connector member having an outer contact surface converging toward and terminating in a pointed end and extending into said conductor end to flare said strands at said end, said female and male connector members having interfitting inner and outer screw threads, respectively, to advance said male connector member relative to said female connector member and grip said strands between said inner and outer contact surfaces to form an electric connection between said male connector and said conductor, said inner contact surface being generally tapered at an angle in relation to the longitudinal axis of said female connector member that is less than the angle of said outer contact surface forms in relation to the longitudinal axis of said male connector member to form a converging passage between said inner and outer contact surfaces, said passage converging along said conductor toward said end of said conductor to distribute said strands substantially uniformly around the periphery of said outer contact surface, said outer contact surface being provided by a malleable material having a hardness less than the hardness of said strands and said strands are pressed into said outer contact surface to form depressions in said malleable material for increased contact surface area between said strands and male connector member.

6. An electric connector as set forth in claim 1 wherein said outer contact surface is tapered at an angle of about 40 degrees to the longitudinal axis of said male connector member and said inner contact surface is tapered at an angle of about 30 degrees to said longitudinal axis of said female connector member.

7. An electric connector comprising:

a hollow female connector member having a circular cross section having a central throughbore with a smaller straight bore section of substantially uniform diameter defining a smaller inner surface and an enlarged bore section gradually enlarging away from said straight bore section defining a generally tapered inner contact surface, an electric conductor having a bundle of electrically conductive strands extending through said throughbore and terminating in an end in said enlarged bore section, a solid male connector member having a circular cross section concentrically arranged with said female connector member and having a convexly curved outer contact surface converging toward and terminating in a pointed end and extending into said conductor end to flare said strands at said end in a radially outward direction, said female and male connector members having interfitting inner and outer screw threads, respectively, to advance said male connector member relative to said female connector member and grip said strands between said inner and outer contact surfaces to form a tight electric connection between said male connector and said conductor, said inner contact surface being generally tapered at an angle in relation to the longitudinal axis of said female connector member that is less than the angle of said outer contact surface forms in relation to the longitudinal axis of said male connector member to form a converging passage between said inner and outer contact surfaces direction, said passage converging along said conductor toward said end of said conductor to distribute said strands substantially uniformly around the periphery of said outer contact surface, said smaller inner surface of said straight bore section and said inner contact surface merging with one another along a rounded inner surface to avoid weakening, kinking and breaking of a strand in contact with said inner contact surfaces and form a compressed, flattened area in the strand in contact with said rounded inner surface for increased contact surface area between said conductor and said male connector member, said outer contact surface being convexly curved to avoid kinking and breaking of a strand and form a compressed, flattened area in the strand in contact with said convex curved contact surface for increased contact surface area between said conductor and said male connector member, said outer contact surface being tapered at an angle of about 40 degrees to the longitudinal axis of said male connector member and said inner contact surface is tapered at an angle of about 30 degrees to said longitudinal axis of said female connector member, said outer contact surface being provided by a malleable material having a hardness less than the hardness of said strands and said strands are pressed into said outer contact surface to form depressions in said malleable material for increased contact surface area between said strands and male connector member.

* * * * *